US006220685B1

(12) United States Patent
Hirath et al.

(10) Patent No.: US 6,220,685 B1
(45) **Date of Patent: *Apr. 24, 2001**

(54) HEAT-INSULATED WALL

(75) Inventors: Jürgen Hirath, Heidenheim; Markus Schütte, Nürnberg, both of (DE)

(73) Assignee: BSH Bosch und Siemens Hausgeraete GmbH, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/174,294

(22) Filed: Oct. 16, 1998

(30) Foreign Application Priority Data

Oct. 16, 1997 (DE) ..... 197 45 859

(51) Int. Cl.[7] ..... A47B 96/04
(52) U.S. Cl. ..... 312/406; 52/788.1; 220/592.27
(58) Field of Search ..... 312/400, 406, 312/406.1, 409; 428/69, 75, 76; 62/45.1, DIG. 13, 907, 440, 465; 220/592.27, 560.12, 560.1; 445/70, 73; 215/13.1; 105/357; 52/788.1, 800.1, 800.11, 800.12

(56) References Cited

U.S. PATENT DOCUMENTS 1,898,977 2/1933 Cornstock .
1,984,007 * 12/1934 Babbitt ..... 52/588.1
2,024,065 * 12/1935 Schellens ..... 220/592.27
2,989,156 6/1961 Brooks et al. .
3,161,265 12/1964 Matsch et al. .
5,634,256 6/1997 Fritschi .

FOREIGN PATENT DOCUMENTS 195 20 020 A1 12/1996 (DE) .
0 011 239 A1 5/1980 (EP) .
763412 * 12/1956 (GB) ..... 428/75

OTHER PUBLICATIONS

International Publication WO 99/20962 (Hirath et al.), dated Apr. 29, 1999.

* cited by examiner

*Primary Examiner*—Peter M. Cuomo
*Assistant Examiner*—Jerry A. Anderson
(74) *Attorney, Agent, or Firm*—Herbert L. Lerner; Laurence A. Greenberg; Werner H. Stemer

(57) ABSTRACT

A heat-insulated wall is formed of two covering layers configured to be substantially vacuum-tight and are disposed at a distance from one another. The two covering layers are connected to one another by a connecting profile that runs along their contour and has a U-shaped cross-section. The two covering layers together with the connecting profile, enclose an intermediate space which can be evacuated and filled with heat-insulating material which can also be evacuated. The U-shaped connecting profile is equipped with limbs whose material thickness is at least approximately in the same order of magnitude as the material thickness of the covering layers, and has a base which connects the two limbs and is configured like a sheet.

10 Claims, 2 Drawing Sheets

HEAT-INSULATED WALL

BACKGROUND OF THE INVENTION

Field of the Invention

The invention relates to a heat-insulated wall having two covering layers, which are configured to be substantially vacuum-tight, and are disposed at a distance from one another. The two covering layers are connected to one another by a connecting profile (which runs along their contour and is configured with an essentially U-shaped cross-section). The two covering layers together with the connecting profile, enclose an intermediate space which can be evacuated and filled with an evacuable heat insulating material.

In the case of heat-insulated walls and housings which are based on vacuum insulation technology, and as are used, for example, in the case of domestic appliances such as refrigerators and freezers, metallic materials, for example stainless-steel sheeting, are used as the outer covering layers for the walls and housings, owing to the requirement for long-term diffusion sealing. For reasons of diffusion sealing, metallic connecting profiles are once again used to connect the two outer covering layers and are welded to the outer covering layers in a diffusion-proof manner. In this case, in addition to thin sheet-metal strips, connecting elements formed from thin sheeting and constructed with a cross section like a U-profile are also used as connecting profiles. The material thickness of the connecting elements is in all locations in the same order of magnitude as the material thickness of the outer covering layers, in order to make it possible to ensure the necessary process reliability in the manufacturing sequence of the heat-insulated wall. However, owing to their thermal conductivity, connecting elements having such a material thickness result in the thermal conductivity of the heat-insulated wall rising. Such a rise is relatively unproblematic if glass-fiber panels are used as the filling materials for the heat-insulated walls since, owing to their characteristics, such panels allow the insulating walls to have an extremely low thermal conductivity. However, at the same time, the use of glass-fiber panels results in the manufacturing costs for the heat-insulated walls being relatively high, owing to the costs of the glass-fiber panels. Furthermore, owing to their relatively high density, the use of glass-fiber panels results in the heat-insulated walls and housings filled with them being difficult to handle. Not only is the handling difficult during the production and completion to form a refrigerator but, in the end, also for the end user, owing to the weight resulting from them. However, other available supporting materials, such as open-cell polyurethane foam or polystyrene foam which do not have the disadvantageous characteristics of the glass-fiber panels are unsuitable for use as a filling material for heat-insulated walls owing to the low thermal conductivity which can be achieved with their use in conjunction with the connecting profiles that are now available, since the rise in the thermal conductivity caused by the use of such connecting profiles for the heat-insulated wall reaches an order of magnitude that is virtually impractical for use in refrigerators.

SUMMARY OF THE INVENTION

It is accordingly an object of the invention to provide a heat-insulated wall that overcomes the above-mentioned disadvantages of the prior art devices of this general type, which has simple constructional measures.

With the foregoing and other objects in view there is provided, in accordance with the invention, a heat-insulated wall, including: a connecting profile having a U-shaped cross-section, two limbs each with a given material thickness, and a base configured as a sheet connecting the two limbs; an evacuable heat-insulating material; and two covering layers disposed at a distance from one another and connected to each other by the connecting profile in an at least substantially vacuum-tight manner, the two covering layers together with the connecting profile enclosing an intermediate space that can be evacuated and filled with the evacuable heat-insulating material, the two covering layers each having a material thickness substantially the same order of magnitude as the given material thickness of the two limbs.

The object is achieved according to the invention by the fact that the U-shaped connecting profile is equipped with limbs whose material thickness is at least approximately in the same order of magnitude as the material thickness of the covering layers. The connecting profile also has a base that connects the two limbs and is configured like a sheet.

The connecting profile as claimed in the invention with its limbs that has thick walls in comparison to its base allows, with minimized thermal conduction, not only the use of robust clamping devices, without any problems during manufacture, for fixing the connecting profile with respect to the outer thin sheeting covering layers, but also simplifies the capability to join the connecting profile to the covering layers. Furthermore, owing to the fact that the material thickness of the limbs is in the same region as the material thickness of the covering layers, it is possible to use beam-welding processes with a high degree of process reliability. Which in turn allows a high process rate (for example about 10 m/min or more), for example by using a laser-beam welding process, as a result of which the manufacturing costs for a heat-insulated wall or a heat-insulated housing are considerably reduced. Furthermore, the connecting profile according to the invention makes it possible to use cost-effective heat-insulation materials, such as open-pore polyurethane foam or open-cell polystyrene foam as a supporting body without, in the process, changing the thermal conductivity of the insulating wall to an order of magnitude which will be completely impractical for use in refrigerators.

The connecting profile on the one hand and the covering layers of the heat-insulated walls on the other hand can be produced to be particularly diffusion-resistant on the one hand and be particularly dimensionally stable on the other hand if, as is provided according to a preferred embodiment of the subject matter of the invention, the connecting profile and the covering layers are formed from stainless steel or corrosion-protected steel.

A further preferred embodiment of the subject matter of the invention provides for the limbs and the base of the connecting profile to be configured as separate individual parts, which are joined together by welding to form the connecting profile.

Such a solution offers the capability, depending on the application of the heat-insulating wall, to combine various material thicknesses for the base, configured like a sheet, with various material thicknesses for the limbs of the connecting profile. Furthermore, it is also possible to use base elements that have different profiles, reduce the thermal conductivity and can be profiled particularly cost-effectively as individual parts. In addition, the use of welding to connect the individual parts between the limbs and the sheet-like base, which is thinner than the limbs, results in an integral material joint which gives the connecting profile a certain stiffness. As a result of which the connecting profile can be handled without any problems in mass production.

A particularly high process rate for the production of the connecting profile is obtained if, according to a next preferred embodiment of the subject matter of the invention, the welded connection between the limbs and the base is produced by a beam-welding process.

The use of such a welding process allows the amount of energy required to melt the connection profile to be metered exactly so that only the connecting zone and its immediate vicinity are melted thus avoiding damage, for example from overheating, particularly on the sheet-like base.

The base and the limbs of the U-shaped connecting profile are welded particularly reliably over the entire joint length without any welding faults if, according to a next preferred embodiment of the subject matter of the invention, the welded connection between the base and the limbs is disposed essentially at right angles to the longitudinal axis of the limbs.

The limbs and the base of the U-shaped connecting profile are connected to one another particularly permanently and robustly if, according to a further preferred embodiment of the subject matter of the invention, the base of the U-shaped connecting profile at least approximately covers its limbs.

According to an alternative embodiment for the production of the connecting profile, the connecting profile is formed by non-cutting shaping of a rectangular stainless-steel sheet or corrosion-protected steel plate which has a sheet-like material thickness and whose broader plate sides rest against one another in a plurality of layers, by being folded over a plurality of times, in order to form the limbs of the connecting profile.

Such a solution allows the production of a connecting profile in one process, so that no additional production steps, such as the joining together of the base and the limbs as well as their connection, are required.

According to a further preferred embodiment of the subject matter of the invention, the connecting profile is composed from a plurality of longitudinal partial pieces that are connected to one another by tongue and groove connections on the limbs.

The subdivision of the connecting profile into corresponding longitudinal partial pieces makes the production of geometrically complicated corner profiles, for example for refrigerators, considerably easier, in which case the tongue and groove connection between the individual partial pieces always ensures that they are joined together in an accurately positioned manner. Furthermore, the tongue and groove connection between the individual longitudinal partial pieces also ensures that the welding of the connecting profile to the outer covering layers can be carried out without any additional auxiliary measures, even beyond the connecting point of the individual partial pieces, so that the vacuum-tightness at the connection points is also ensured in a simple manner, in one operation.

According to a next preferred embodiment of the subject matter of the invention, the base of the connecting profile is equipped with shapes that enlarge its effective width.

Such a measure considerably reduces the thermal conductivity of the base and thus at least considerably constrains any rise in the thermal conductivity.

A heat-insulated housing is constructed particularly expediently for a refrigerator and for its door that is used to close its refrigeration compartment if, according to a next preferred embodiment of the subject matter of the invention, the housing and the door are constructed according to the invention.

The construction of the heat-insulated wall is particularly advantageous both in terms of heat engineering and with respect to the manufacturing costs, and is particularly suitable for mass production of a heat-insulated housing for a refrigerator and a door of a refrigerator. The housing and the door can likewise be disposed of particularly easily and without damaging the environment.

The construction of the heat-insulated wall can be applied just as advantageously to the production of an oven muffle of a household oven as to the production of a refrigerator if, according to a last preferred embodiment of the subject matter of the invention, the heat-insulated housing of the oven muffle is constructed in accordance to the invention.

Other features which are considered as characteristic for the invention are set forth in the appended claims.

Although the invention is illustrated and described herein as embodied in a heat-insulated wall, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
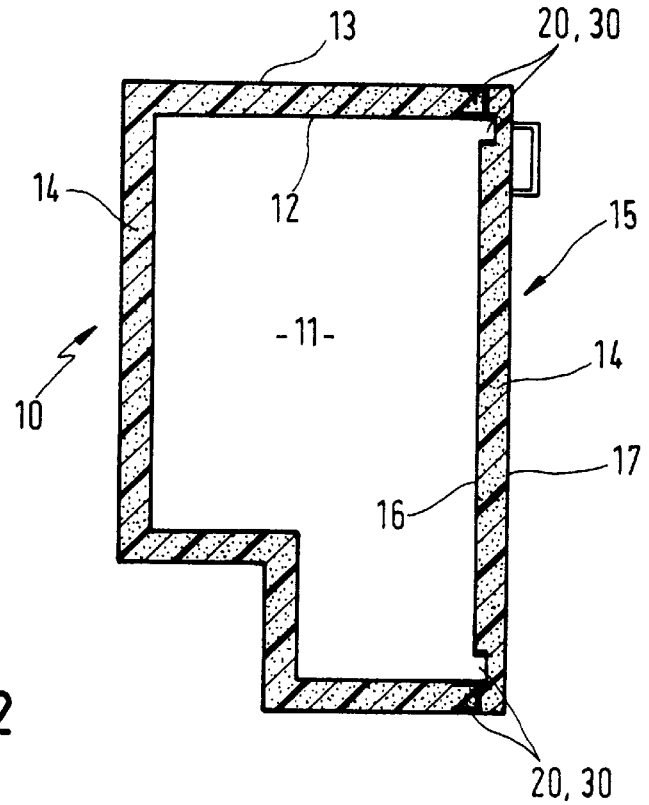
FIG. 1 is a sectional view of a heat-insulated housing of a domestic refrigerator having an outer casing and inner cladding that are connected to a connecting profile having a U-shaped cross section forming an intermediate space which is filled with a heat-insulating material according to the invention.

In all the figures of the drawing, sub-features and integral parts that correspond to one another bear the same reference symbol in each case. Referring now to the figures of the drawing in detail and first, particularly, to FIG. 1 thereof, there is shown a heat-insulated housing 10 which is suitable for use as a domestic refrigerator or freezer. Within the housing 10 is a useful area or compartment 11 that is clad by a covering layer 12 used as inner cladding. A further covering layer 13 is provided at a distance from the covering layer 12. The further covering layer 13 is used as an outer cladding and, like the inner cladding, is formed from stainless-steel sheeting or corrosion-protected steel sheeting. The space between the covering layer 12 and the covering layer 13 creates an intermediate space which is filled with an evacuable heat-insulating supporting material 14, for example open-cell polyurethane foam or open-cell polystyrene foam which is present in the form of a panel. The materials are also used as insulation and supporting materials for a door 15 that covers the useful area 11 in a heat-insulating manner. The door 15 is attached to the housing 10 and is formed from two covering layers 16 and 17 which are at a distance from one another and between which the heat-insulating supporting material 14 is incorporated. Both the covering layers 16 and 17 of the door 15 and that of the housing 10 are connected to one another in a vacuum-tight manner by a connecting profile 20 or 30, respectively. The connecting profile 20, 30 is configured with a U-shape cross section, and the connecting profile 20 (which is described using the example of the housing 10) in FIG. 2 and the alternative embodiment of the connecting profile 30 (which is explained using the example of the housing 10) are illustrated in more detail in FIG. 4.

Figure 2:
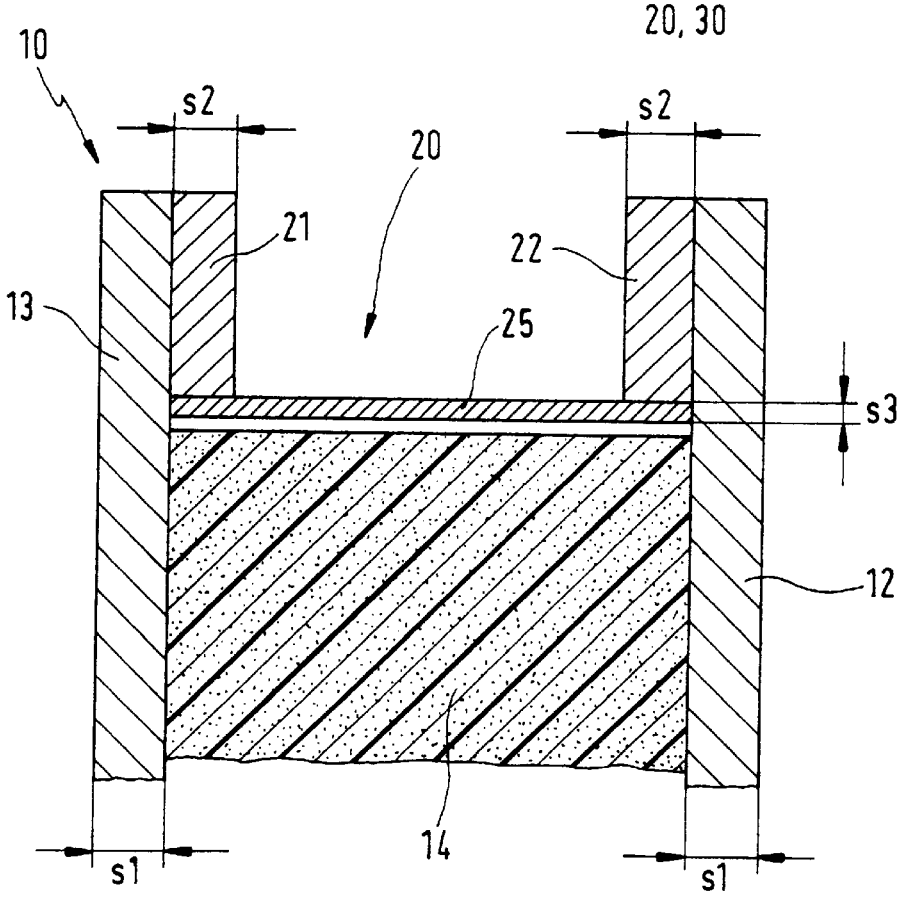
FIG. 2 is a cross-sectional view of a detail of the housing rotated through 90°, in the region of the connecting profile according to a first embodiment for the connecting profile whose limbs, which are configured to be reinforced in comparison with its sheet-like base, are connected with an integral material joint to the base.

As is shown in particular in FIG. 2, the connecting profile 20 is composed of separate individual parts which include limbs 21, 22 for forming the U-profile cross section. The limbs are disposed on mutually facing inner sides of the covering layers 12 and 13. The covering layers 12, 13 have a material thickness s1 corresponding essentially to the material thickness s2 of the limbs 21, 22.

Figure 3:
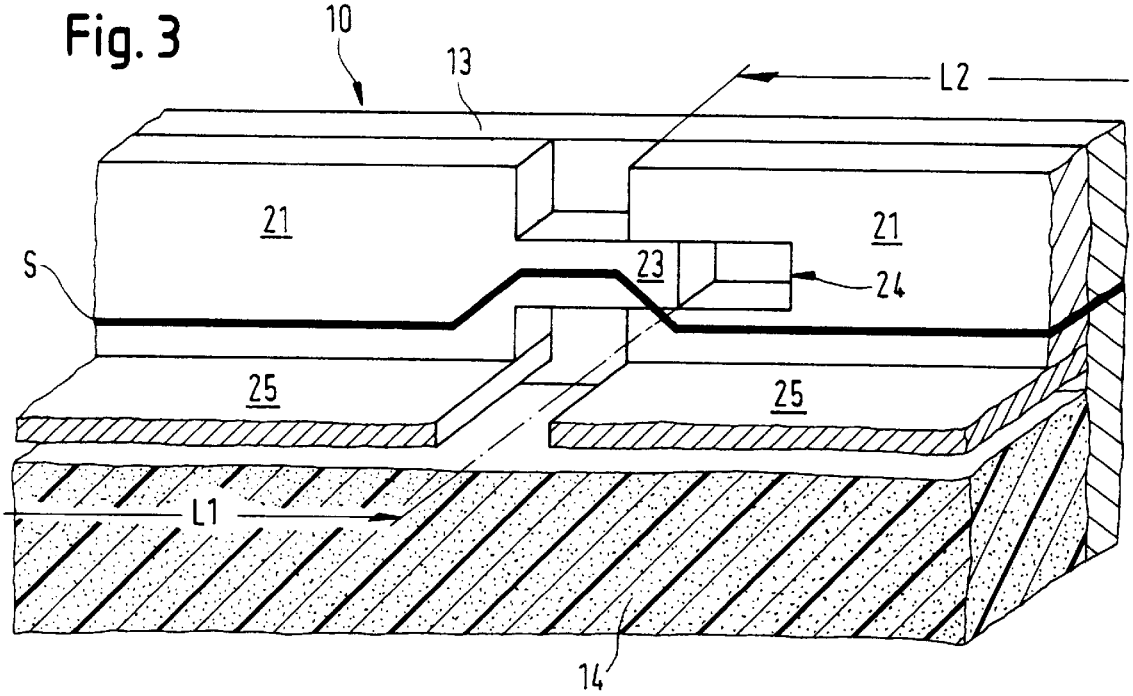
FIG. 3 is a perspective, longitudinal sectional view of a section of the housing, shown rotated through 90°, in the region of the connecting profile, whose longitudinal sections are joined together with a tongue and groove connection.

To make the production easier and to improve the joint with the covering layers 12, 13, the limbs 21 and 22 are subdivided into longitudinal sections L1 and L2 which can be joined together (see FIG. 3). At one of its ends, the longitudinal section L1 is equipped with a tongue 23, which can be inserted into a groove 24 (which is incorporated in one of the ends of the longitudinal section L2) to form a tongue and groove connection. The limbs 21 and 22 are connected to one another only by a connecting element or base 25 of the U-profile. The length of the base 25 is matched to the length of the partial pieces L1 and L2 of the limbs 21 and 22, and whose material thickness s3 is considerably less than the material thickness s2 of the limbs 21 and 22. A value of 0.4 mm has already given very usable results for the material thickness s2 of the limbs 21 and 22, and a value of 0.1 mm for the material thickness s3 of the base 25. In terms of considerably reducing the thermal conduction via the base 25 and attaching the limbs 21 and 22 in a reliable process along the insides of the covering layers, a beam-welding process is used. The base 25 is likewise connected to the limbs 21 and 22 by a beam-welding process, for example by laser-beam welding or electron-beam welding. The integral material joint that is produced by the welding process occupies the entire contact surface between the pieces in order to achieve an adequate connection force between the pieces.

In the joined state, the connecting profile 20 is inserted between the covering layers 12 and 13, with its base 25 facing the heat-insulating supporting material 14. When the intermediate space filled with the heat-insulating supporting material 14 is evacuated, the base 25 (which is of sheet-like construction), can be supported on the heat-insulating supporting material 14 and is at the same time disposed recessed from the free edges of the housing 10, for protection against accidental damage. The vacuum-tight attachment of the connecting profile 20 to the covering layers 12 and 13 is achieved by a weld seam S which runs along the limbs 21 and 22 and which, in order to avoid air enclosures which would reduce the insulation capability of the vacuum, must be provided as close as possible to the base 25 of the connecting profile 20 (see FIG. 3).

Figure 4:
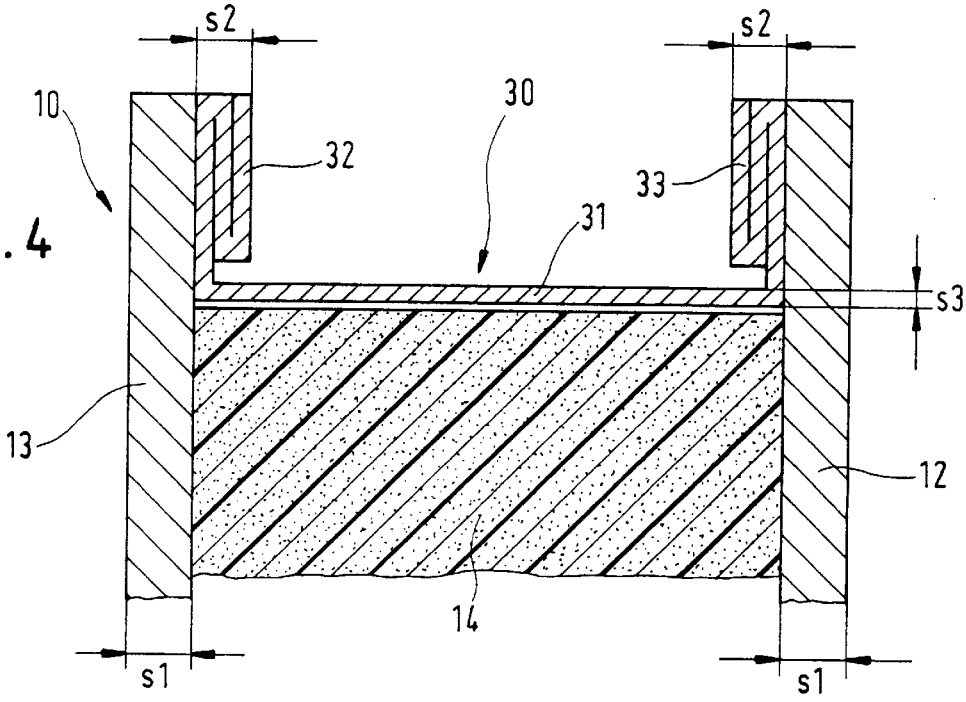
FIG. 4 is a cross-sectional view of a detail of the housing, rotated through 90°, in the region of the connecting profile according to a second embodiment for the connecting profile, whose limbs, which are to be reinforced in comparison with its sheet-like base, are formed by folding over the sheet-like material a plurality of times.

FIG. 4 shows a further embodiment of the connecting profile 30 that is configured as a U-profile cross section. The limbs 32 and 33 are connected to one another by its base 31 and are manufactured from a stainless-steel sheeting blank whose material thickness corresponds to the material thickness s3 of the base 31. The limbs 32 and 33, which are integrally connected to the base 31, are produced by multiple layering of the side edges of the sheet-like material blank without any gaps, for example by folding it over a plurality of times, so that the limbs 32 and 33 have a material thickness s2 which corresponds essentially to the material thickness s1 of the covering layers 12 and 13. Like the connecting profile 20 and in order to simplify its production, the connecting profile 30 can be subdivided into a plurality of partial pieces which are connected to one another analogously to the partial pieces L1 and L2 of the connecting profile 20 and, like them, are fixed on the covering layers 12 and 13 and in a vacuum-tight manner by welding.

Figure 5:
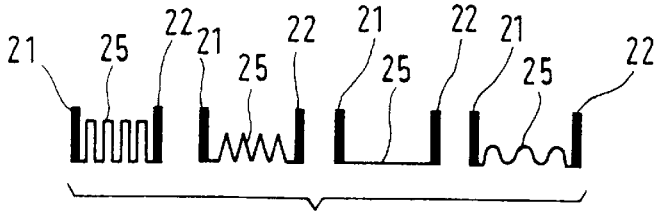
FIG. 5 is a diagrammatic view of a plurality of construction variants of the connecting profile, each having a differently profiled base.

As is evident in particular from FIG. 5, different shapes are possible for the bases 25 and 31. Cross-sectional shapes that are used in addition to the smooth-surfaced version additionally reducing the thermal conduction of the bases 25 and 31 by enlarging their effective length.

The connecting profile described using the example of the housing 10 can also be used to connect the covering layers 16 and 17 to the door 15, in which case the covering layers must be appropriately configured in order to incorporate the connecting profile.

Contrary to the exemplary embodiment described above, it is also feasible for the connecting profile 20, 30 to be placed over the free ends of the covering layers 12, 13, 16, 17.

The construction (which has been described using the example of a domestic refrigerator or freezer) of a heat-insulated wall, for example in the form of a housing 10, can also be applied to a heat-insulated oven (cooker) muffle which is used in a domestic oven. In which case, in contrast to the heat-insulated wall that is used for cooling purposes, the supporting material 14 between the covering layer 12 and 13 must be adapted in an appropriate manner to the temperature requirements for the oven muffle.

We claim:

1. A heat-insulated wall, comprising:

a connecting profile having a U-shaped cross-section, two limbs each with a given material thickness, and a base configured as a sheet connecting said two limbs to one another and having a material thickness less than said given material thickness;

an evacuable heat-insulating material; and two covering layers disposed at a distance from one another and connected to each other by said connecting profile in an at least substantially vacuum-tight manner, said two covering layers together with said connecting profile enclosing an intermediate space that is evacuated and filled with said evacuable heat-insulating material, said two covering layers each having a material thickness substantially the same order of magnitude as said given material thickness of said two limbs.

2. The heat-insulated wall according to claim 1, wherein said connecting profile and said two covering layers are formed from a material selected from the group consisting of stainless steel and corrosion-protected steel.

3. The heat-insulated wall according to claim 1, wherein said two limbs and said base are separate individual parts joined by a welded connection to form said connecting profile.

4. The heat-insulated wall according to claim 3, wherein said welded connection between said two limbs and said base is produced by a beam-welding process.

5. The heat-insulated wall according to claim 3, wherein said two limbs each have a longitudinal axis, and said welded connection between said base and each of said two limbs is disposed substantially at right angles to said longitudinal axis of said two limbs.

6. The heat-insulated wall according to claim 1, wherein each of said two limbs has a bottom and said base of said connecting profile at least substantially covers said bottom of each of said two limbs.

7. The heat-insulated wall according to claim 1, wherein said connecting profile is formed by non-cutting shaping of a rectangular stainless-steel sheet having broader sheet sides, said broader sheet sides are folded over a plurality of times such that each of said broader sheet sides rests against itself in a plurality of layers for forming said two limbs of said connecting profile.

8. The heat-insulated wall according to claim 1, wherein said connecting profile is formed by non-cutting shaping of a corrosion-protected steel sheet having broader sheet sides, said broader sheet sides are folded over a plurality of times such that each of said broader sheet sides rests against itself in a plurality of layers for forming said two limbs of said connecting profile.

9. The heat-insulated wall according to claim 1, wherein said two limbs are composed of a plurality of longitudinal partial pieces having tongues and grooves formed therein for connecting said longitudinal partial pieces to one another.

10. The heat-insulated wall according to claim 1, wherein said base of said connecting profile is formed with shapes for enlarging an effective length of said base.

* * * * *